US010546437B2

(12) United States Patent
Bungo

(10) Patent No.: US 10,546,437 B2
(45) Date of Patent: Jan. 28, 2020

(54) SMALL BOAT FAILURE PREDICTION SYSTEM

(71) Applicant: Honda Motor Co., Ltd., Tokyo (JP)

(72) Inventor: Keiichiro Bungo, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 91 days.

(21) Appl. No.: 15/933,269

(22) Filed: Mar. 22, 2018

(65) Prior Publication Data

US 2018/0286151 A1 Oct. 4, 2018

(30) Foreign Application Priority Data

Mar. 29, 2017 (JP) ..... 2017-064062

(51) Int. Cl.

| | |
|---|---|
| ***G07C 5/08*** | (2006.01) |
| ***B63H 20/00*** | (2006.01) |
| ***B63B 35/00*** | (2006.01) |
| ***B63H 20/20*** | (2006.01) |
| ***B63H 20/12*** | (2006.01) |
| ***B63H 25/02*** | (2006.01) |
| ***B63H 21/21*** | (2006.01) |

(52) U.S. Cl.

CPC ..... *G07C 5/0841* (2013.01); *B63H 20/00* (2013.01); *B63B 2035/004* (2013.01); *B63B 2758/00* (2013.01); *B63H 20/20* (2013.01)

(58) Field of Classification Search

CPC .... G07C 5/0841; G07C 5/0808; B63H 20/12; B63H 20/00; B63H 2025/022; B63H 2021/216; B63H 20/20; B63B 2758/00; B63B 2035/004

See application file for complete search history.

(56) References Cited

U.S. PATENT DOCUMENTS

| | | | | |
|---|---|---|---|---|
| 5,964,208 | A * | 10/1999 | Yamashita | F02D 41/1456 123/674 |
| 7,051,689 | B2 * | 5/2006 | Tamura | F01N 3/2006 123/90.15 |
| 9,116,137 | B1 * | 8/2015 | Gettings | G01N 33/00 |
| 9,170,625 | B1 * | 10/2015 | Gettings | G05B 15/02 |
| 9,213,327 | B1 * | 12/2015 | Gettings | H04M 1/72569 |
| 10,410,440 | B2 * | 9/2019 | Remboski | B60W 50/0205 |

(Continued)

FOREIGN PATENT DOCUMENTS

JP 2010089760 A 4/2010

*Primary Examiner* — Frederick M Brushaber

(74) *Attorney, Agent, or Firm* — Duft & Bornsen, PC

(57) ABSTRACT

A failure prediction system having small boats operable by operators, each mounted with an outboard motor equipped with an engine and an Electronic Control Unit and a computer located in a land office connected to the ECU. The ECU acquires boat ID assigned to one small boat on which one operator boards and his personal ID, accesses the computer to acquire past manipulation data of the acquired personal ID for all boats, acquires manipulation data of the one operator during current run, merge the data with past data to generate merged data. Then, it select a parameter in the generated data and set a normal value range by the parameter, assesses whether parameter in the data during current run is within the range, and determines the outboard motor mounted on the one boat is in failure when the parameter is out of the range.

15 Claims, 8 Drawing Sheets

(56) References Cited

U.S. PATENT DOCUMENTS

| | | | | |
|---|---|---|---|---|
| 2005/0263058 | A1* | 12/2005 | Suemori | B63H 21/22<br>114/144 R |
| 2011/0196572 | A1* | 8/2011 | Tsuchikiri | B60R 25/00<br>701/33.4 |
| 2011/0238258 | A1* | 9/2011 | Singh | G07C 5/0808<br>701/31.4 |
| 2011/0313616 | A1* | 12/2011 | Tsuchikiri | B60W 50/0205<br>701/33.7 |
| 2013/0033908 | A1* | 2/2013 | Schwarz | B60L 3/003<br>363/55 |
| 2013/0079976 | A1* | 3/2013 | Kuroda | B62D 5/0487<br>701/34.4 |
| 2013/0158917 | A1* | 6/2013 | Uchida | H01M 10/441<br>702/63 |
| 2015/0095718 | A1* | 4/2015 | Otsuka | G06F 11/3409<br>714/47.3 |
| 2016/0018799 | A1* | 1/2016 | Gettings | G05B 15/02<br>700/19 |
| 2016/0018800 | A1* | 1/2016 | Gettings | G05B 15/02<br>700/19 |
| 2016/0019780 | A1* | 1/2016 | Gettings | G08C 17/02<br>340/12.5 |
| 2018/0268624 | A1* | 9/2018 | Remboski | G07C 5/0808 |
| 2018/0286151 | A1* | 10/2018 | Bungo | G07C 5/0841 |
| 2019/0032576 | A1* | 1/2019 | Muldal | F23N 5/242 |

* cited by examiner

SMALL BOAT FAILURE PREDICTION SYSTEM

CROSS-REFERENCE TO RELATED APPLICATION

This application is based upon and claims the benefit of priority from Japanese Patent Application No. 2017-064062 filed on Mar. 29, 2017, the contents of which are incorporated herein by reference.

BACKGROUND OF THE INVENTION

Field of the Invention

This invention relates to a failure prediction system for small boats such as motor boats and other small watercrafts.

Description of the Related Art

While motorboats and other small watercraft are inspected for failures before boarding, the ability to predict failures at an earlier time would be convenient. In this regard, Japanese Unexamined Patent Publication No. 2010-89760A proposes a technology for enabling prediction of failures, although for vehicles, not small boats.

The technology of the reference predicts vehicle failure using driving data at time of trouble occurrence collected by many ordinary vehicles driving daily in cities. Namely, the technology is configured to predict failure by comparing with standard values time-series data regarding multiple driving parameters at time of trouble occurrence collected and stored in memory devices of electronic control units of many vehicles at time of trouble occurrence.

Being configured as stated above, the technology of the reference predicts vehicle failure but does not take into account that a particular vehicle may not always be driven by the same driver and is apt to be also driven by another driver or drivers. When two or more drivers are involved, the individual drivers often have different driving habits (idiosyncrasies) that may affect the operating parameters.

SUMMARY OF THE INVENTION

An object of this invention is therefore to overcome this issue as it relates to small boats by providing a small boat failure prediction system that achieves accurate failure prediction by identifying individual operator (pilot) idiosyncrasies.

In order to achieve the object, this invention provides a small boat failure prediction system, comprising: a plurality of small boats each mounted with an outboard motor equipped with an internal combustion engine, a steering device and an electronic control unit, the small boats being operable by one of a plurality of operators through manipulation of the steering device such that the electronic control unit controls operation of the outboard motor in response to the manipulation of the steering device; and a computer connected to the electronic control unit equipped on each of the small boats through a communication means; wherein the electronic control unit comprises: an ID acquire unit configured to acquire boat ID assigned to one of the small boats on which one of the operators boards and personal ID of the one of the operators on board; a past manipulation data acquire unit configured to access the computer to acquire past manipulation data associated with the acquired personal ID of the one of the operators for all of the small boats operated by the one of the operators; a manipulation data merge unit configured to acquire manipulation data of the one of the operators on the one of the small boats during current run, merge the manipulation data during the current run with the past manipulation data to generate merged manipulation data, and transmit the generated merged manipulation data to the computer; a normal value range set unit configured to select a parameter based on data having predesignated correlation in the generated merged manipulation data, and set a normal value range based on the selected parameter; a parameter assess unit to assess whether parameter corresponding to the selected parameter in the manipulation data during the current run is within the set normal range; and a failure predict unit configured to determine the outboard motor mounted on the one of the boats is in failure when the parameter is out of the set normal range.

DETAILED DESCRIPTION OF THE INVENTION

A small boat failure prediction system according to an embodiment of this invention is explained with reference to the attached drawings in the following.

Figure 1:
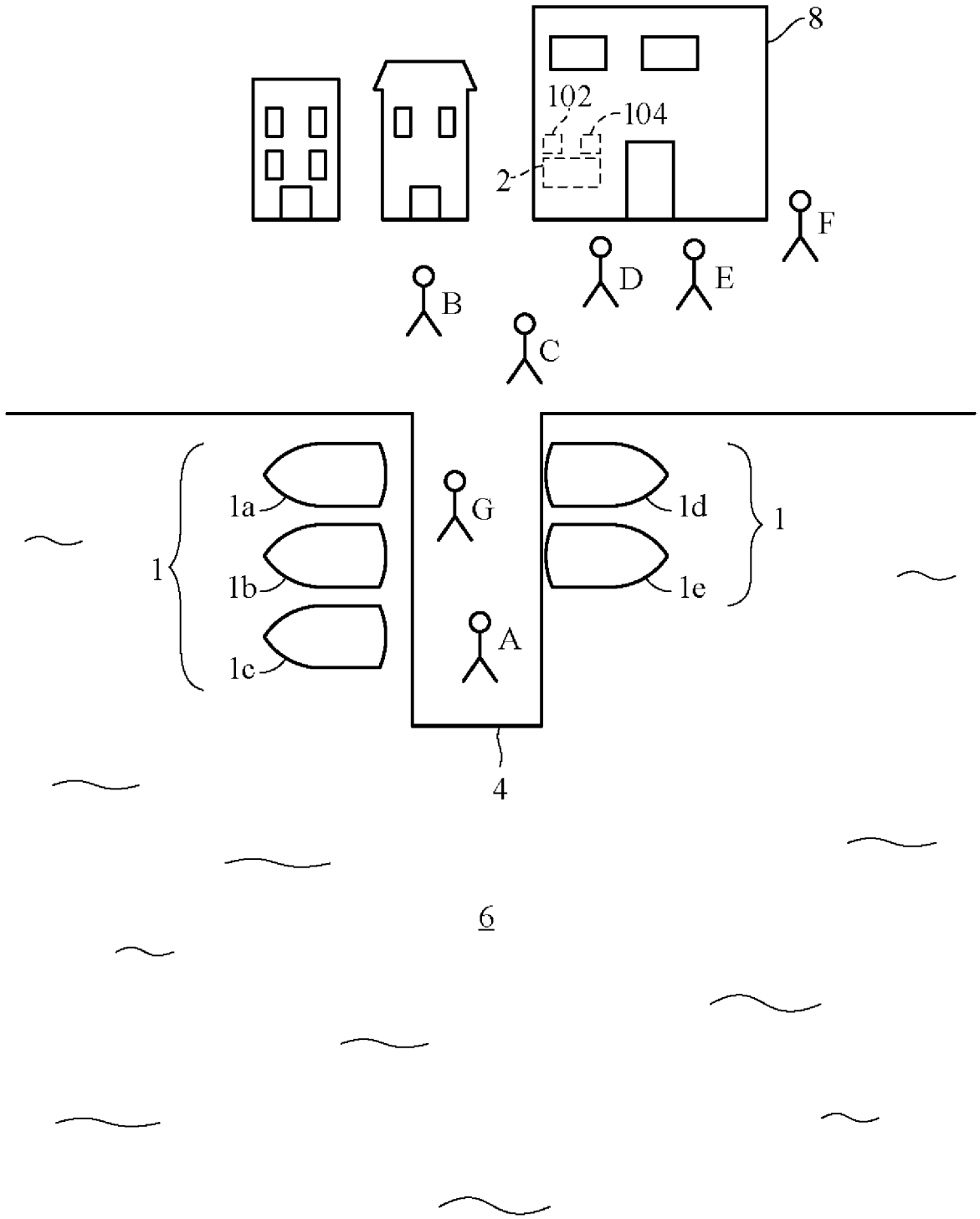
FIG. 1 is a schematic diagram generally illustrating a small boat failure prediction system according to an embodiment of this invention.
Figure 2:
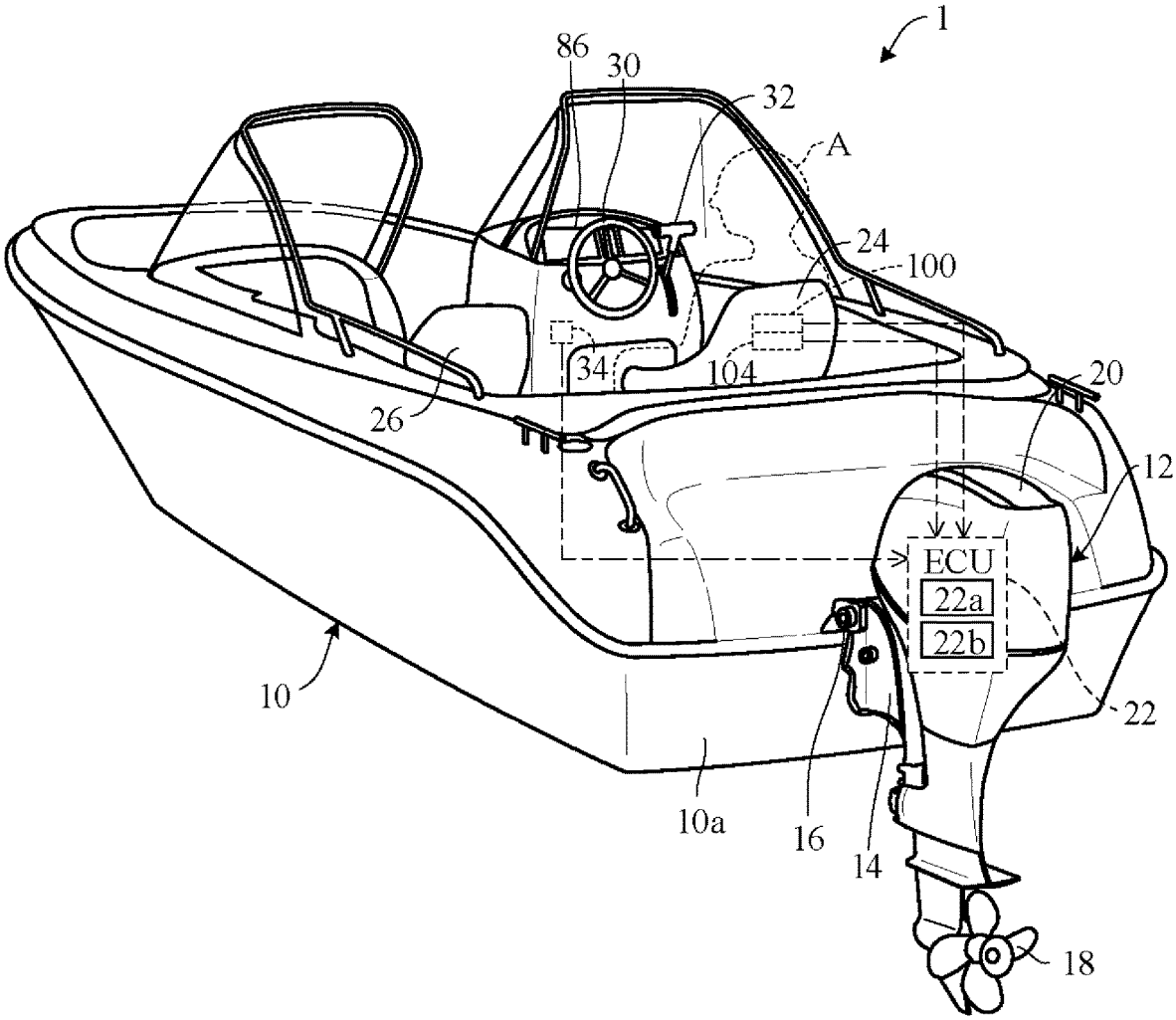
FIG. 2 is a perspective view of the small boat of FIG. 1.
Figure 3:
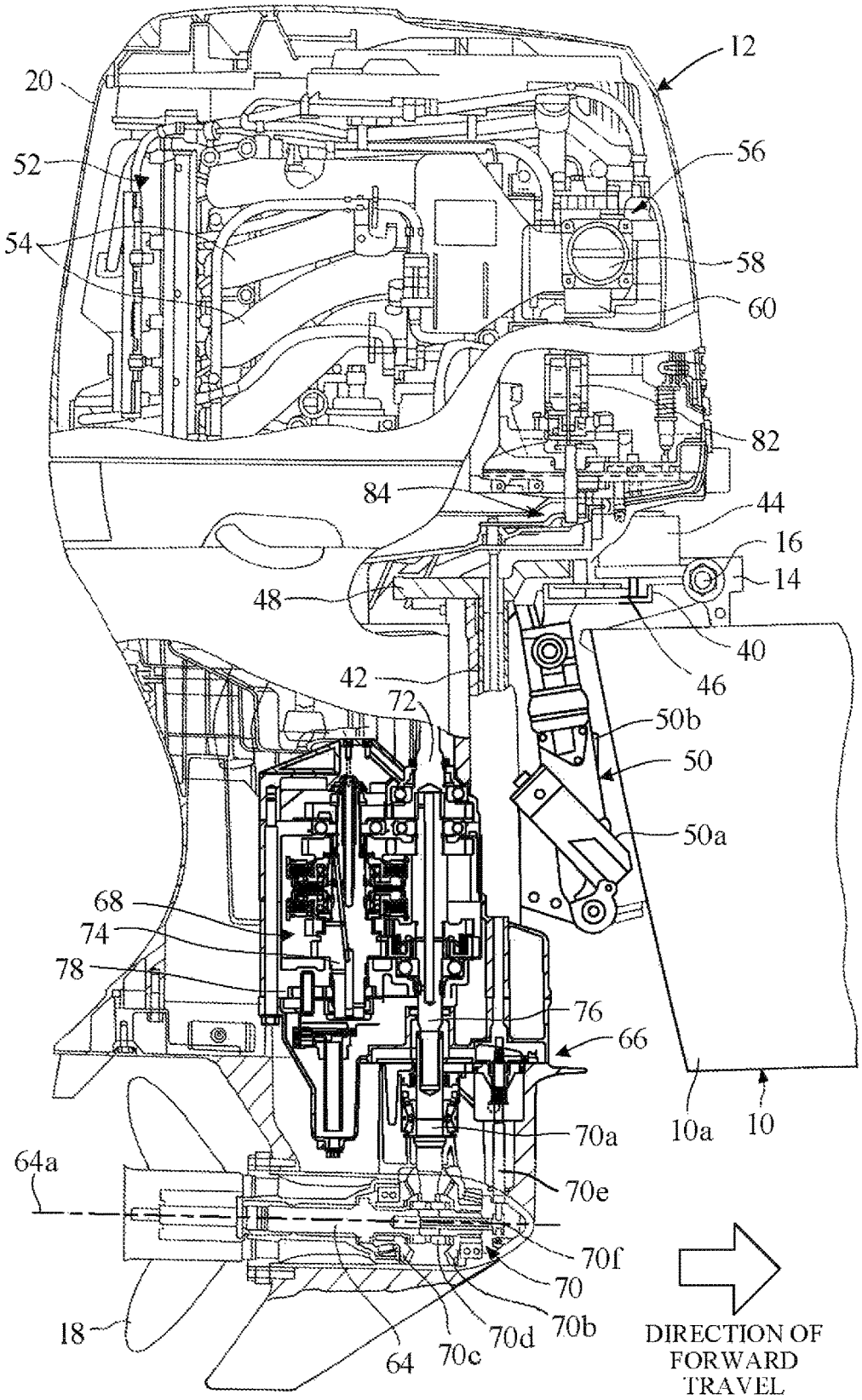
FIG. 3 is an enlarged side view of an outboard motor mounted on the small boat of FIG. 2.
Figure 4:
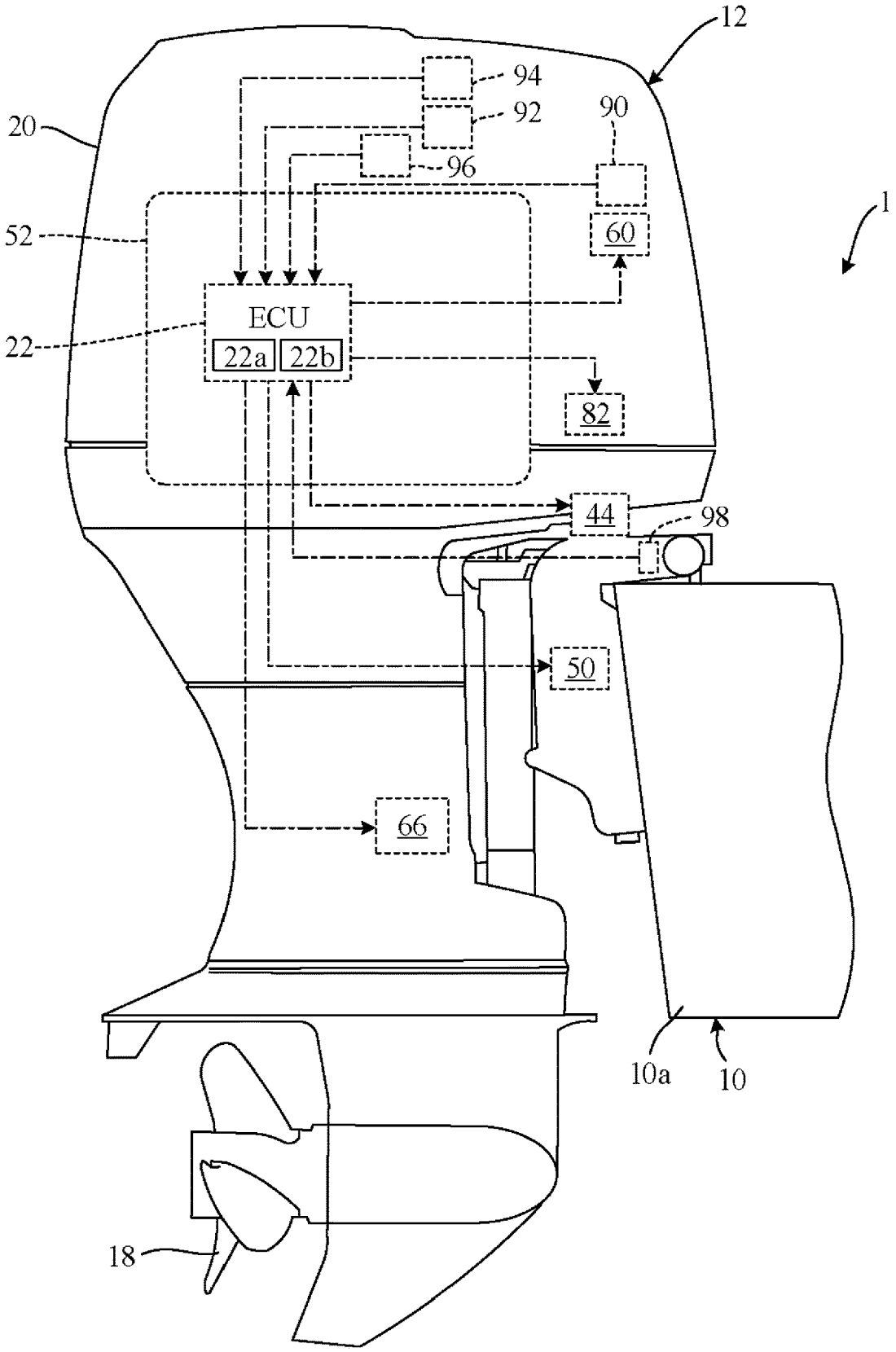
FIG. 4 is an explanatory diagram of an essential part of the outboard motor of FIG. 3.

FIG. 1 is a schematic diagram generally illustrating a small boat failure prediction system according to an embodiment of this invention; FIG. 2 is a perspective diagram of the small boat of FIG. 1; FIG. 3 is an enlarged side view of an outboard motor (partially in section) mounted on the small boat of FIG. 2; and FIG. 4 is an explanatory diagram of an essential part of the outboard motor.

Reference numeral 1 in FIG. 1 designates a small boat (hereinafter called "boat"). For convenience of explanation in the following, the boat 1 will be explained first with reference to FIG. 2. As illustrated, the boat 1 is actually a motorboat.

In the embodiment, the boat 1 is a plurality of commercial motorboats owned by a taxi-boat company is taken as an example. The taxi-boat company is engaged in a costal area business of offering customers transport service to requested destinations by boat.

The boat 1 has a hull 10, and an outboard motor 12 is mounted on the hull 10. To be more specific, the outboard motor 12 is attached to a stern 10*a* of the hull 10 by means of stern brackets 14 and a tilting shaft 16.

The outboard motor 12 comprises an engine (internal combustion engine, described later), a propeller 18 driven by the engine, an engine cover 20 enclosing the engine, and an electronic control unit (hereinafter called ECU) 22 installed in an engine room, i.e., a space inside the engine cover 20, for controlling operation of the outboard motor 12. The ECU 22 comprises a microcomputer equipped with a processor (CPU) 22*a*, memories (ROM, RAM) 22*b* coupled to the processor 22*a*, and so on.

A cockpit seat 24 for an operator A (indicated by broken line) is provided at the fore-aft middle of the hull 10, and seats 26 for passengers are provided beside and behind the cockpit seat 24. A steering wheel 30 turnable by the operator is installed in the cockpit 24.

A shift-throttle lever (steering device) 32 operable by the operator is installed near the cockpit seat 24. The shift-throttle lever 32 can be rocked fore and aft from an initial position by the operator to input forward/reverse instructions and engine speed NE regulation instructions, including acceleration/deceleration instructions, to the engine.

A GPS (Global Positioning System) receiver 34 for receiving GPS signals is installed at a suitable location on the hull 10. The GPS receiver 34 sends the ECU 22 signals indicating position data of the boat 1 obtained from the GPS signals.

FIG. 3 is an enlarged partially sectional side view of the outboard motor 12, and FIG. 4 is an enlarged side view of the outboard motor 12.

As shown in FIG. 3, the outboard motor 12 is equipped with a swivel shaft 42 accommodated inside a swivel case 40 to be rotatable around a vertical axis, and an electric steering motor 44. The electric steering motor 44 operates through a reduction gear mechanism 46 and a mount frame 48 to drive the swivel shaft 42, thereby rotating the swivel shaft 42. As a result, the outboard motor 12 is steered clockwise or counterclockwise (around a vertical axis) with the swivel shaft 42 as a steering axis.

A power tilt-trim unit 50 installed near the swivel case 40 enables adjustment of tilt angle or trim angle of the outboard motor 12 relative to the hull 10 by tilting up/down or trimming up/down.

The power tilt-trim unit 50 integrally comprises a hydraulic cylinder mechanism 50*a* for tilt angle adjustment and a hydraulic cylinder mechanism 50*b* for trim angle adjustment, and the hydraulic cylinder mechanisms 50*a* and 50*b* extend and retract to raise and lower the swivel case 40 around the tilting shaft 16 as an axis of rotation, thereby tilting or trimming the outboard motor 12 up and down. The hydraulic cylinder mechanisms 50*a* and 50*b* are connected to a hydraulic circuit (not shown) installed in the outboard motor 12 and are extended and retracted by hydraulic pressure received therefrom.

The outboard motor 12 is fitted with the engine (now assigned with reference numeral 52) at its upper portion. The engine 52 is a spark-ignition, water-cooled gasoline engine. The engine 52 is positioned above the water surface and enclosed by the engine cover 20.

A throttle body 56 is connected to an air intake pipe 54 of the engine 52. The throttle body 56 has an internal throttle valve 58 and an integrally attached electric throttle motor 60 for open-close driving the throttle valve 58.

An output shaft of the electric throttle motor 60 is connected through a reduction gear mechanism (not shown) to the throttle valve 58, and the electric throttle motor 60 is operated to open and close the throttle valve 58 so as to meter air intake of the engine 52 and thereby regulate engine speed NE.

The outboard motor 12 is supported to be rotatable around a horizontal shaft and is equipped with a propeller shaft 64 connected at one end to the propeller 18 for transmitting power to the propeller 18 from the engine 52 and a transmission 66 interposed between the engine 52 and propeller shaft 64 and having first, second and optionally additional gear positions.

An axis 64*a* of the propeller shaft 64 is oriented to lie substantially parallel to the water surface when the power tilt-trim unit 50 is in initial state (state when trim angle is initial angle). The transmission 66 comprises a speed-change mechanism 68 shiftable among multiple speeds and a shift mechanism 70 whose shift position can be changed among a forward position, a reverse position and a neutral position.

The speed-change mechanism 68 is constituted as a parallel-shaft stepped speed-change mechanism having, arranged in parallel, an input shaft 72 connected to a crankshaft (not shown) of the engine 52, a countershaft 74 connected to the input shaft 72 through gears, and an output shaft 76 connected to the countershaft 74 through multiple gears.

A hydraulic pump 78 for pumping hydraulic oil (lubricating oil) to a hydraulic clutch for gear shifting and lubrication points is connected to the countershaft 74. The input shaft 72, countershaft 74, output shaft 76 and hydraulic pump 78 are housed in a case 80, and a lower part of the case 80 constitutes an oilpan 80*a* for receiving hydraulic oil.

The shift mechanism 70 is connected to the output shaft 76 of the speed-change mechanism 68 and comprises a drive shaft 70*a* rotatably supported to lie parallel to the vertical axis, a forward bevel gear 70*b* and a reverse bevel gear 70*c* that are connected to and rotated by the drive shaft 70*a*, and a clutch 70*d* capable of engaging the propeller shaft 64 with either the forward bevel gear 70*b* or the reverse bevel gear 70*c*.

A shift electric motor 82 for driving the shift mechanism 70 is installed inside the engine cover 20, and its output shaft is adapted to be connectable via a reduction gear mechanism 84 to an upper end of a shift rod 70*e* of the shift mechanism 70. Therefore, when the shift electric motor 82 is driven to suitably displace the shift rod 70*e* and a shift slider 70*f*, the clutch 70*d* operates to change the shift position among forward position, reverse position and neutral position.

When the shift position is forward position or reverse position, rotation of the output shaft 76 of the speed-change mechanism 68 is transmitted through the shift mechanism 70 to the propeller shaft 64, whereby the propeller 18 is rotated to produce propulsion (propelling force) in the forward or reverse direction of the hull 10. The outboard motor 12 is further equipped with an electric power supply, such as a battery, attached to the engine 52, and operating power is supplied to the motors 44, 60 and 82 and other destinations from this power supply.

As shown in FIG. 2, a display 86 for displaying an ocean area to be navigated is provided near the cockpit seat 24.

A throttle position sensor 90 installed near the throttle valve 58 as shown in FIG. 4 produces an output indicating opening (angle) TH of the throttle valve 58. Further, a crankangle sensor 92 attached near the crankshaft of the engine 52 outputs a pulse signal every predetermined crankangle.

An engine temperature sensor 94 disposed on a cylinder wall surface of the engine 52 produces an output indicating engine temperature of the engine 52, and an intake air pressure sensor 96 disposed at a suitable location on the air intake pipe 54 of the engine 52 outputs a signal indicating absolute pressure inside the air intake pipe 54 (engine load).

A trim angle sensor 98 disposed near the tilting shaft 16 produces an output proportional to trim angle of the outboard motor 12 (rotation angle around a pitch axis of the outboard motor 12 relative to the hull 10).

Returning to FIG. 1, the small boat failure prediction system according to this embodiment comprises a plurality of boats 1 and a computer 2. As stated earlier, the boats 1 are a plurality of boats owned by a taxi-boat company, namely, a plurality of boats moored on sea 6 near a dock 4. Specifically the boats 1 comprises five boats 1*a*, 1*b*, 1*c*, 1*d*, and 1*e*.

The computer 2 is a personal computer located in an office 8 of the taxi-boat company or a smartphone or other mobile terminal that can be carried by an owner/manager or employee of the boat-taxi company (i.e., is located at a position other than the boat 1), or by an operator introduced later. Alternatively, the computer 2 can be one installed at a remote location and connected through a cloud.

Each of the five boats 1 is operable by one of a plurality of operators, namely, one of seven operators A, B, C, D, E, F, and G. Which of the seven operators is in charge of which boat is not fixed, and when a customer (passenger) requests service, any of the five boats 1 that is available for use is suitably selected.

The operator boards the selected boat 1, guides the customer to the seat 26 while taking the operator's seat 24, starts the engine 52 of the outboard motor 12 of the boarded boat 1, and navigates away from the dock 4 toward a destination a relatively short distance across the sea 6.

As was explained mainly with reference to FIG. 2, each of the five boats 1 is equipped with the outboard motor 12, and the outboard motor 12 is fitted with the ECU 22 that controls operation of the outboard motor 12 in response to the operator's manipulation of a steering device like the shift-throttle lever 32. The computer 2 is connected with each of the ECU 22 through a communication means and acquires manipulation data indicating the states of these operator manipulations from the ECU 22.

Figure 5:
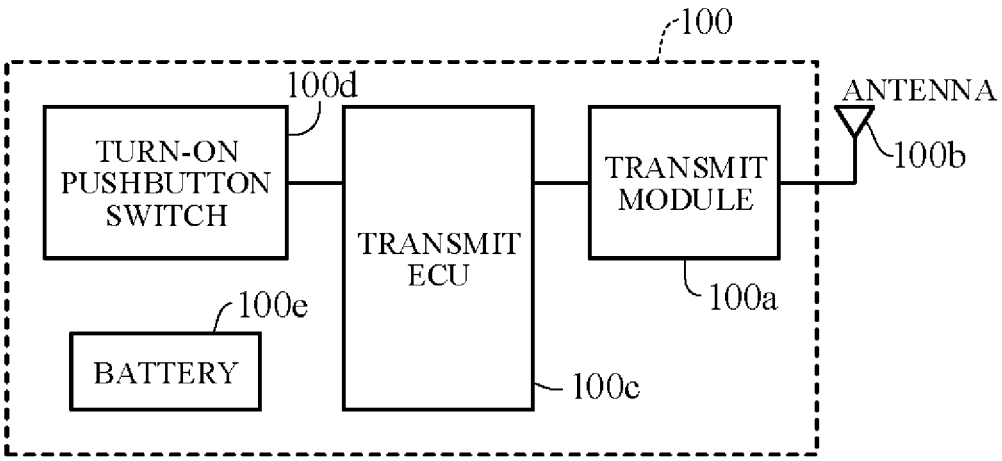
FIG. 5 is a block diagram showing the configuration of a transmitter of FIG. 2.
Figure 6:
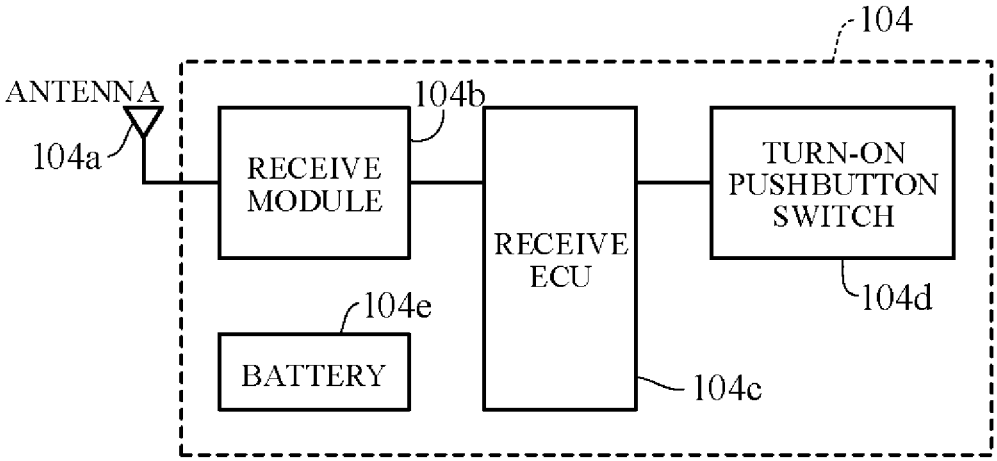
FIG. 6 is a block diagram showing the configuration of a receiver of FIG. 2.

As shown in FIG. 2, a transmitter 100 and a receiver 104 are provided on the hull 10 as communication means. FIG. 5 is a block diagram showing the configuration of the transmitter 100, and FIG. 6 is a block diagram showing the configuration of the receiver 104. Although illustration is omitted, the computer 2 is also provided with a similarly configured transmitter 102 and a similarly configured receiver 104.

As shown in FIG. 5, the transmitter 100 comprises a transmit module 100*a* for generating a transmission radio wave, an antenna 100*b* connected to the transmit module 100*a* for transmitting the generated radio wave omnidirectionally, a transmit ECU (Electronic Control Unit) 100*c* for controlling operation of the transmit module 100*a*, a turn-on pushbutton switch 100*d*, and a battery 100*e*.

As shown in FIG. 6, the receiver 104 comprises an antenna 104*a* for receiving the radio wave transmitted from the transmitter 100 of the computer 2, a receive module 104*b* for processing the radio wave received by the antenna 104*a*, a receive ECU (Electronic Control Unit) 104*c* for controlling operation of the receive module 104*b*, the turn-on pushbutton switch 100*d*, and a battery 104*e*. When the computer 2 is constituted as a remotely located server connected through a cloud, it is connected through an Internet communication network or the like.

Figure 7:
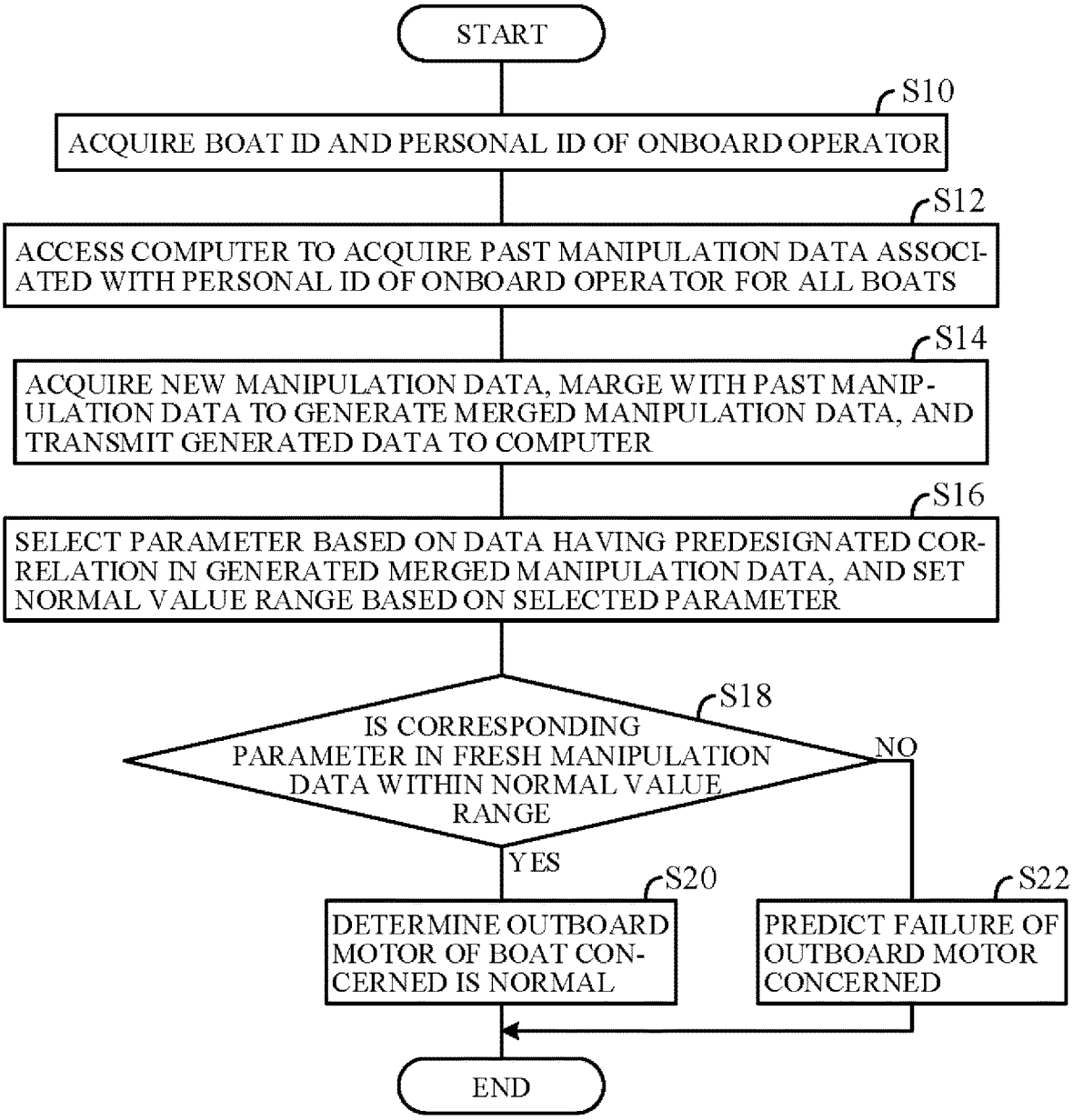
FIG. 7 is a flowchart showing processing by an ECU of FIG. 2.
Figure 8:
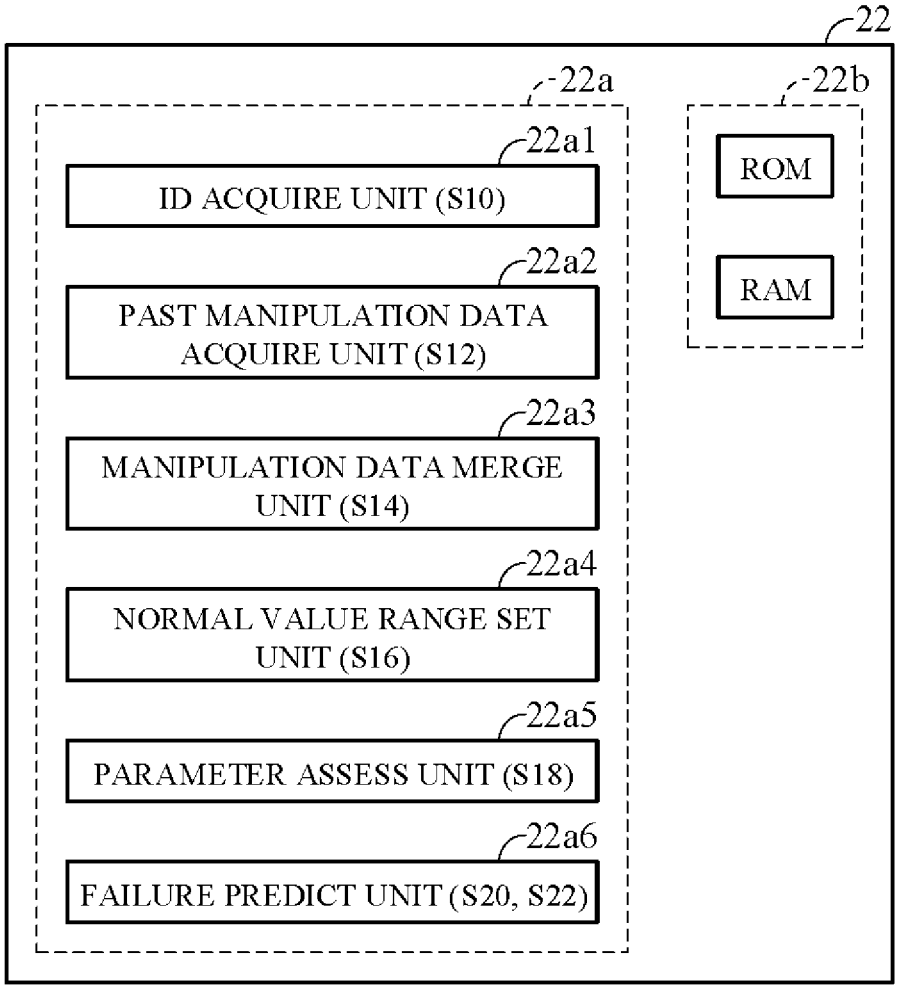
FIG. 8 is a block diagram functionally indicating processing by the ECU of FIG. 7.

FIG. 7 is a flowchart showing processing by the ECU 22 corresponding to operations of the small boat failure prediction system according to this embodiment, and FIG. 8 is a block diagram functionally indicating processing by the ECU 22.

As shown in FIG. 8, the processor 22*a* of the ECU 22 has an ID acquire unit 22*a*1, a past manipulation data acquire unit 22*a*2, a manipulation data merge unit 22*a*3, a normal value range set unit 22*a*4, a parameter assess unit 22*a*5, and a failure predict unit 22*a*6. More specifically, the processor 22*a* and memory 22*b* are configured to perform acquiring ID at 22*a*1, acquiring past manipulation data at 22*a*2, merging manipulation data at 22*a*3, setting normal value range at 22*a*4, assessing parameter at 22*a*5, and predicting failure at 22*a*6.

In actual operation, the flowchart of FIG. 7 is executed by the ECU 22 of the outboard motor 12 of each of the five boats 1 when one of the operators boards that boat.

Now to explain, in S10, when one of operators boards one of the boat 1 (the subject boat), the ECU 22 acquires (reads) the boat ID assigned to the subject boat and the personal ID of the onboard operator. For the purpose of the processing shown in FIG. 7, the subject boat is assumed to be the boat 1*d* among the five boats shown in FIG. 1 and the onboard operator to be on board is A among the seven operators.

Each operator is given a specific operator key having the operator's personal ID stored in memory, and by requiring the operator to use the operator key upon boarding, the personal ID of the operator who boards can be acquired in S10 from the use of the operator key. Alternatively, if an immobilizer is used, the personal ID of the boarding pilot can be obtained from that instead of from an operator key.

Next, in S12, the ECU 22 accesses the computer 2 and acquires past manipulation data associated with the acquired personal ID of the onboard pilot A, for all of the five boats 1 operated by operator A, i.e., not only for the subject boat 1*d* but also for the boats 1*a*, 1*b*, 1*c*, and 1*e*, if operated by A in the past.

These manipulation data include all data related to manipulating and running of the boat 1, including, inter alia, operation of the outboard motor 12 occurring in response to the onboard operator's manipulation of the shift-throttle lever 32, as well as behavior of the hull 10 owing to operation of the outboard motor 12, and additionally include at least engine speed NE of the engine 52 of the outboard motor 12, and temperature TE of the engine 52, specifically, its change per unit time period (temperature rise rate).

Next, in S14, new manipulation data are freshly acquired (detected) from manipulation of the boat 1*d* by the onboard operator (A) during the current run, and the fresh data acquired and the past manipulation data acquired from the computer 2 in S12 are merged to generate merged manipulation data, whereafter the generated merged manipulation data are transmitted to the computer 2.

Next, in S16, a parameter is selected based on data having predesignated correlation in the generated merged manipulation data, and a normal value range is set based on the selected parameter.

Figure 9:
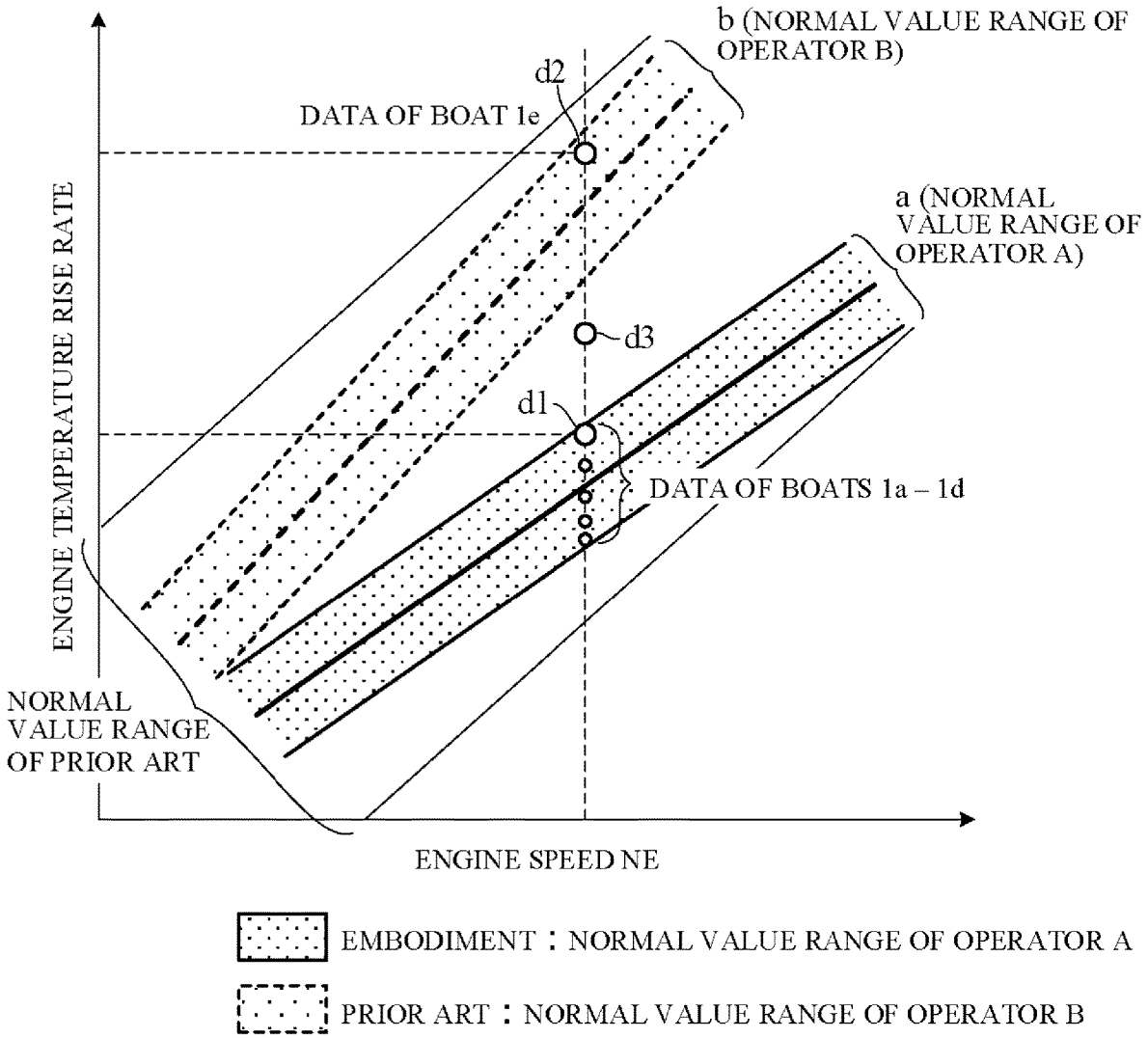
FIG. 9 is an explanatory view of a normal value range referred to in the flowchart of FIG. 7.

Explaining this with reference to FIG. 9, the data having predesignated correlation here are change of engine temperature TE per predetermined period (temperature rise rate), and engine speed NE of the engine 52, and the parameter is engine temperature rise rate relative to engine speed. Engine speed NE is detected by the crankangle sensor 92 and engine temperature TE by the temperature sensor 94.

In this embodiment, the normal value range for operator A is designated by symbol a and that for operator B symbol b in FIG. 9. Although not shown, similar ranges will be designed for the rest of operators C to G. The normal value range is a range within which is deemed normal for the operator concerned.

Next, in S18, in which it is assessed whether parameter (corresponding to selected based on data having the predesignated correlation) in fresh manipulation data (engine temperature rise rate per predetermined period relative to engine speed) is within the normal value range a.

When the parameter in the fresh manipulation data is determined to be in the normal value range a in S18, the program goes to S20, in which it is determined that the outboard motor 12 of the boat 1*d* is normal, and when determined to be out of the normal value range a, the program goes to S22, in which it is predicted that the outboard motor 12 of the boat 1*d* is in failure, in its engine 52 or in its cooling mechanism, temperature sensor 94 or the like. This is simultaneously displayed on the display 86 as necessary.

Now to explain this with reference to FIG. 9, if the conventional technology is pursued, the normal value range would be like that illustrated bottom opposite to those of this embodiment. Namely, according to the prior art, the normal range when multiple operators operate multiple outboard motors 12 would be that between the upper and lower limits of dispersion of rise rate of engine temperature TE with respect to engine speed NE.

Therefore, with the prior art, when different operators, e.g. operators A and B, all (both) operators using the outboard motors 12 of the five different boats 1*a*, 1*b*, 1*c*, 1*d* and 1*e*, and should the parameters become as indicated by the manipulation data d1, d2 and d3 in FIG. 9, all of the outboard motors 12 of the five boats 1 would be determined normal.

This is because the conventional technology defines the normal value range assuming not only all sorts of use environments but also all sorts of operator's use patterns, so that the normal value range comes to be broadly defined.

However, to the best of the inventor's knowledge, operation of the outboard motor 12 is, with the exception of steering, simple, because it is done mainly by manipulating the shift-throttle lever 32, and as a result of this, operators tend to run constantly at full throttle, or sometimes alternately with moderate acceleration, and are thus apt to display their individual operating habits (idiosyncrasies).

Against this backdrop, the inventor's attention was caught by the fact that rise rate (change per unit time) of engine temperature TE with respect engine speed NE is a parameter whose value is generally high during full-throttle running and low during moderate acceleration running.

So focusing on rise rate per unit time of engine temperature TE with respect engine speed NE as a parameter that facilitates apprehension of such operator idiosyncrasies, the inventor learned that failure of the outboard motor 12 can be predicted by defining a normal value range based thereon, and achieved this invention as a result.

Specifically, the normal value range in FIG. 9 is defined to distinguish between two operators, where operator A data are indicated by a and operator B data by b. With this, data d3, for instance, can be predicted failure, and occurrence of failure can therefore be detected earlier than by the prior art.

From this it is possible to infer problems of the engine 52 such as deficient cooling water or temperature sensor 94 malfunction. On the other hand, when the rise rate of engine temperature TE is a negative value falling below the normal value range of the pilot concerned, failure of the cooling water circulating pump of the engine 52 (pump illustration omitted in FIG. 3 and other drawings) or of its temperature sensor 94 can be inferred.

In addition, teaching capability such as for advising the operator to constrain temperature increase can be incorporated, in the computer 2, for example.

As stated above, the embodiment is configured to have a small boat failure prediction system (method) comprising: a plurality of small boats (1, e.g., 1*a*, 1*b*, 1*c*, 1*d*, 1*e*) each mounted with an outboard motor (12) equipped with an internal combustion engine (52), a steering device (32) and an electronic control unit (22), the small boats (1) being operable by one of a plurality of operators (e.g., A, B, C, D, E, F, G) through manipulation of the steering device (32) such that the electronic control unit (22) controls operation of the outboard motor (12) in response to the manipulation of the steering device (32); and a computer (2) connected to the electronic control unit (22) equipped on each of the small boats (1) through a communication means (100, 104); wherein the electronic control unit (22) comprises: an ID acquire unit (22*a*1; S10) configured to acquire boat ID assigned to one of the small boats (1; e.g., 1*d*) on which one of the operators (e.g., A) boards and personal ID of the one of the operators on board; a past manipulation data acquire unit (22*a*2; S12) configured to access the computer (2) to acquire past manipulation data associated with the acquired personal ID of the one of the operators (e.g., A) for all of the small boats (1; e.g., 1*a*, 1*b*, 1*c*, 1*d*, 1*e*) operated by the one of the operators (e.g., A); a manipulation data merge unit (22*a*3; S14) configured to acquire manipulation data of the one of the operators (e.g., A) on the one of the small boats (1; e.g., 1*d*) during current run, merge the manipulation data during the current run with the past manipulation data to generate merged manipulation data, and transmit the generated merged manipulation data to the computer (2); a normal value range set unit (22*a*4; S16) configured to select a parameter based on data having predesignated correlation in the generated merged manipulation data, and set a normal value range based on the selected parameter; a parameter assess unit (22*a*5; S18) to assess whether parameter corresponding to the selected parameter in the manipulation data during the current run is within the set normal range; and a failure predict unit (22*a*6; S22) configured to determine the outboard motor (12) mounted on the one of the boats (1; e.g., 1*d*) is in failure when the parameter is out of the set normal range.

With this, it becomes possible to achieve accurate failure prediction by identifying individual operator idiosyncrasies.

In the system, the normal value range set unit (22*a*4; S16) is configured to select engine temperature rise rate relative to engine speed as the parameter based on the data of speed and temperature of the internal combustion engine (52) of the outboard motor (12). With this, it becomes possible to achieve more accurate failure prediction. a In the system, the normal value range set unit (22*a*4; S16) is configured to set the normal value range for each of the small boats (1) and for each of the operators. With this, it becomes possible to achieve more accurate failure prediction.

In the system, a key storing the personal ID in memory is prepared for each of the operators to be used for operating the outboard motor (12) on the small boats (1) such that the personal ID of the one of the operators on board is acquired from the key. With this, it becomes possible to achieve more accurate failure prediction.

In the system, the computer (2) is located at a position other than the small boat (1). With this, in addition to the effects and advantages mentioned above, the result can be easily utilized in office management.

Although the foregoing explanation is made taking a commercial motorboat of a taxi-boat company as an example, the boat is not limited to this and, for example, can instead be a private motorboat or a fishing boat.

Moreover, while the information communication terminal is a smartphone, it is not limited to a smartphone and can instead be a personal computer or tablet terminal having image taking capability, preferably video image taking capability, or be a mobile telephone having image taking capability, preferably video image taking capability. In addition, these can be connected to and used together with the display 86 at the cockpit seat 24 of the boat 1.

While the present invention has been described with reference to the preferred embodiments thereof, it will be understood, by those skilled in the art, that various changes and modifications may be made thereto without departing from the scope of the appended claims.

What is claimed is:

1. A small boat failure prediction system, comprising:

a plurality of small boats each mounted with an outboard motor equipped with an internal combustion engine, a steering device and an electronic control unit, the small boats being operable by one of a plurality of operators through manipulation of the steering device such that the electronic control unit controls operation of the outboard motor in response to the manipulation of the steering device; and a computer connected to the electronic control unit equipped on each of the small boats through a communication means;

wherein the electronic control unit comprises a processor and memory configured to:

acquire a boat ID assigned to one of the small boats on which one of the operators boards, and to acquire a personal ID of the one of the operators on board;

access the computer to acquire past manipulation data associated with the acquired personal ID of the one of the operators for all of the small boats operated by the one of the operators;

acquire manipulation data of the one of the operators on the one of the small boats during a current run, merge the manipulation data during the current run with the past manipulation data to generate merged manipulation data, and transmit the generated merged manipulation data to the computer;

select a parameter based on data having a predesignated correlation in the generated merged manipulation data, and set a normal value range based on the selected parameter;

assess whether a parameter corresponding to the selected parameter in the manipulation data during the current run is within the set normal range; and determine the outboard motor mounted on the one of the boats is in failure when the parameter is out of the set normal range.

2. The system according to claim 1, wherein the processor and memory are further configured to select an engine temperature rise rate relative to engine speed as the parameter based on the data of speed and temperature of the internal combustion engine of the outboard motor.

3. The system according to claim 1, wherein the processor and memory are further configured to set the normal value range for each of the small boats and for each of the operators.

4. The system according to claim 1, wherein a key storing the personal ID in the memory is prepared for each of the operators to be used for operating the outboard motor on the small boats such that the personal ID of the one of the operators on board is acquired from the key.

5. The system according to claim 1, wherein the computer is located at a position other than the small boat.

6. A small boat failure prediction system, comprising:

a plurality of small boats each mounted with an outboard motor equipped with an internal combustion engine, a steering device and an electronic control unit, the small boats being operable by one of a plurality of operators through manipulation of the steering device such that the electronic control unit controls operation of the outboard motor in response to the manipulation of the steering device; and a computer connected to the electronic control unit equipped on each of the small boats through a communication means;

wherein the electronic control unit has a processor and at least one memory coupled to the processor;

wherein the processor and memory are configured to perform:

ID acquiring of a boat ID assigned to one of the small boats on which one of the operators boards, and of a personal ID of the one of the operators on board;

past manipulation data acquiring by accessing the computer to acquire past manipulation data associated with the acquired personal ID of the one of the operators for all of the small boats operated by the one of the operators;

manipulation data merging by acquiring manipulation data of the one of the operators on the one of the small boats during a current run, merging the manipulation data during the current run with the past manipulation data to generate merged manipulation data, and transmitting the generated merged manipulation data to the computer;

normal value range setting by selecting a parameter based on data having a predesignated correlation in the generated merged manipulation data, and setting a normal value range based on the selected parameter;

parameter assessing by assessing whether a parameter corresponding to the selected parameter in the manipulation data during the current run is within the set normal range; and failure predicting by determining the outboard motor mounted on the one of the boats is in failure when the parameter is out of the set normal range.

7. The system according to claim 6, wherein the processor and memory are configured to perform the normal value range setting by selecting an engine temperature rise rate relative to engine speed as the parameter based on the data of speed and temperature of the internal combustion engine of the outboard motor.

8. The system according to claim 6, wherein the processor and memory are configured to perform the normal value range setting for each of the small boats and for each of the operators.

9. The system according to claim 6, wherein a key storing the personal ID in the memory is prepared for each of the operators to be used for operating the outboard motor on the small boats such that the personal ID of the one of the operators on board is acquired from the key.

10. The system according to claim 6, wherein the computer is located at a position other than the small boat.

11. A small boat failure prediction method, having:

a plurality of small boats each mounted with an outboard motor equipped with an internal combustion engine, a steering device and an electronic control unit, the small boats being operable by one of a plurality of operators through manipulation of the steering device such that the electronic control unit controls operation of the outboard motor in response to the manipulation of the steering device; and a computer connected to the electronic control unit equipped on each of the small boats through a communication means;

comprising the steps of:

ID acquiring of a boat ID assigned to one of the small boats on which one of the operators boards, and of a personal ID of the one of the operators on board;

past manipulation data acquiring by accessing the computer to acquire past manipulation data associated with the acquired personal ID of the one of the operators for all of the small boats operated by the one of the operators;

manipulation data merging by acquiring manipulation data of the one of the operators on the one of the small boats during a current run, merging the manipulation data during the current run with the past manipulation data to generate merged manipulation data, and transmitting the generated merged manipulation data to the computer;

normal value range setting by selecting a parameter based on data having a predesignated correlation in the generated merged manipulation data, and setting a normal value range based on the selected parameter;

parameter assessing by assessing whether a parameter corresponding to the selected parameter in the manipulation data during the current run is within the set normal range; and failure predicting by determining the outboard motor mounted on the one of the boats is in failure when the parameter is out of the set normal range.

12. The method according to claim 11, wherein the step of the normal value range setting selects an engine temperature rise rate relative to engine speed as the parameter based on the data of speed and temperature of the internal combustion engine of the outboard motor.

13. The method according to claim 11, wherein the step of the normal value range setting sets the normal value range for each of the small boats and for each of the operators.

14. The method according to claim 11, wherein a key storing the personal ID in memory is prepared for each of the operators to be used for operating the outboard motor on the small boats such that the personal ID of the one of the operators on board is acquired from the key.

15. The method according to claim 11, wherein the computer is located at a position other than the small boat.

* * * * *